US006850140B1

(12) United States Patent
Gleckner

(10) Patent No.: US 6,850,140 B1
(45) Date of Patent: Feb. 1, 2005

(54) LAYERED MAGNETS AND METHODS FOR PRODUCING SAME

(75) Inventor: Stephen Craig Gleckner, Ontario, NY (US)

(73) Assignee: Magnetic Technologies Corporation, Rochester, NY (US)

( * ) Notice: Subject to any disclaimer, the term of this patent is extended or adjusted under 35 U.S.C. 154(b) by 0 days.

(21) Appl. No.: 10/658,895

(22) Filed: Sep. 10, 2003

(51) Int. Cl.[7] ..... G03G 15/09; H01F 7/02
(52) U.S. Cl. ..... 335/306; 335/302; 399/277
(58) Field of Search ..... 335/302–306; 399/267, 270–277

(56) References Cited

U.S. PATENT DOCUMENTS

| | | | | |
|---|---|---|---|---|
| 4,401,960 A | | 8/1983 | Uchikune et al. | 335/285 |
| 4,638,281 A | | 1/1987 | Baermann | 335/303 |
| 4,727,327 A | * | 2/1988 | Toyoshima et al. | 324/309 |
| 5,148,138 A | * | 9/1992 | Miyata | 335/302 |
| 5,920,262 A | | 7/1999 | Copeland | 340/572.3 |
| 5,965,282 A | | 10/1999 | Baermann | 428/692 |
| 6,060,970 A | | 5/2000 | Bell | 335/285 |
| 6,061,541 A | | 5/2000 | Bessette | 399/277 |
| 6,421,519 B1 | | 7/2002 | Yamashita et al. | 399/277 |

OTHER PUBLICATIONS

Perry's Chemical Engineering Handbook, 1997, *Chapter 18*, 29–32.

* cited by examiner

*Primary Examiner*—Ramon M. Barrera
(74) *Attorney, Agent, or Firm*—Woodcock Washburn LLP

(57) ABSTRACT

The present invention is directed to layered magnets, magnetic rolls made therefrom, methods for increasing the magnetic field strength of a ferritic magnet, methods for increasing the magnetic field strength of a magnetic roll, methods for increasing the magnetic field uniformity of a rare earth magnet, and methods for increasing the magnetic field uniformity of a magnetic roll. Layered magnets include a rare earth magnet having a magnetic field, and superposed upon the rare earth magnet, a layer of ferritic magnet bonded thereto. Layered magnets exhibit greater magnetic field strength and a substantially more uniform magnetic field.

21 Claims, 5 Drawing Sheets

LAYERED MAGNETS AND METHODS FOR PRODUCING SAME

FIELD OF THE INVENTION

The present invention relates generally to magnetic technology. More specifically, the invention relates to layered magnets having enhanced magnetic field strength and magnetic field uniformity.

BACKGROUND OF THE INVENTION

The use of magnetic products in such applications as automobiles, aircraft, reprographics equipment, telecommunications, computer and peripherals, and electronic security systems has long been recognized and new applications are being realized everyday. These products often call for magnets having various characteristics such as high magnetic field strength, magnetic field uniformity, flexibility, durability, and low cost.

One such product, used in the reprographics industry, is a magnetic roll, or magnetic development roll. In reprographic recording, a magnetic roll is concentrically surrounded by a toner tube. In operation, the toner tube is rotated relative to the magnetic roll about a common axis. The magnetic roll in combination with the toner tube is effective for conveying ferromagnetic toner powder from a powder material container onto a photoreceptor thus effecting an electrostatic image. The resultant toner image formed is then transferred to paper and fixed thereto by heating and/or pressing.

Recent demand for high image quality has called for the use of finer magnetic particles as toner materials. As a result, magnetic rolls require higher magnetic field strength in order to attract the finer particles. At the same time, however, the magnetic rolls also require magnetic field uniformity to avoid undesirable inconsistency across the reprographic image.

Well known materials, such as bonded ferritic magnets, are used in magnetic products, such as the aforementioned magnetic rolls, and have the advantage of high magnetic uniformity, low cost and flexibility. These magnets, however, are limited in magnetic field strength. For example, extruded ferritic magnets are limited to a magnetic field strength of approximately 800 Gauss (G), and consequently are limited in their application.

While other magnetic materials, such as rare earth magnets, may also be used in magnetic products to provide increased magnetic field strength, these suffer from other drawbacks. Although other magnetic materials can exceed the strength of ferrite magnets, (e.g., an approximately 10 mm rare earth, neodymium-iron-boron magnet's magnetic field strength is approximately 1500 G), none approach the strength of rare earth magnets without also suffering from lack of magnetic field uniformity, being costly to produce, and lacking in flexibility.

The aforementioned disadvantages make conventional ferritic and rare earth magnets difficult to use in applications, such as high quality image reproduction, requiring flexible and durable magnets having both high magnetic field strength and high magnetic field uniformity. Hence, an ongoing need exists for flexible and durable magnets and articles having both high magnetic field strength and high magnetic field uniformity at a low cost.

SUMMARY OF THE INVENTION

The present invention is directed to layered magnets, magnetic rolls and other articles made therefrom, methods for increasing the magnetic field strength of a ferritic magnet, methods for increasing the magnetic field strength of a magnetic roll, methods for increasing the magnetic field uniformity of a rare earth magnet, and methods for increasing the magnetic field uniformity of a magnetic rolls and other articles.

Layered magnets in accordance with this invention include a rare earth magnet having a magnetic field. Superposed upon the rare earth magnet, a layer of ferritic magnet is bonded thereto. These layered magnets exhibit a greater magnetic field strength than a ferritic magnet alone and a substantially more uniform magnetic field in the direction outward from and normal to the layer of ferritic magnet than the magnetic field in said direction exhibited by the rare earth magnet alone and provide synergistic benefits.

Articles utilizing layered magnets of this invention include magnetic rolls (e.g., for use with a reprographics apparatus). Such magnetic rolls have a cylindrical core, a rare earth magnet superposed upon the cylindrical core, and superposed upon the rare earth magnet, a layer of ferritic magnet bonded thereto to form a layered magnet. Magnetic rolls having a layered magnet in this fashion exhibit greater magnetic field strength than magnetic rolls made with ferritic magnets alone and a substantially more uniform magnetic field in the direction outward from and normal to the layer of ferritic magnet than the magnetic field in said direction exhibited by magnetic rolls made with rare earth magnets alone.

Methods for increasing the magnetic field strength of a ferritic magnet, such as those used in magnetic rolls, include providing a ferritic magnet having a magnetic field and superposing upon the ferritic magnet a layer of rare earth magnet to form a layered magnet. The magnetic field strength of the layered magnet in the direction outward from and normal to the layer of ferritic magnet is substantially greater than the magnetic field strength exhibited by the ferritic magnet alone in the same direction.

Methods for increasing the magnetic field uniformity of a magnetic roll include providing a cylindrical core adapted for use with a reprographics apparatus and superposing upon the cylindrical core a rare earth magnet. Then superposing upon the rare earth magnet, a layer of ferritic magnet. The magnetic field of the magnetic roll, in the direction outward from and normal to the layer of ferritic magnet, is substantially more uniform than the magnetic field exhibited by the rare earth magnet alone in the same direction.

DESCRIPTION OF THE DRAWINGS

The numerous features and advantages of the present invention may be better understood by those skilled in the art by reference to the accompanying detailed description and the following drawings, in which.

DETAILED DESCRIPTION OF ILLUSTRATIVE EMBODIMENTS

Figure 1:
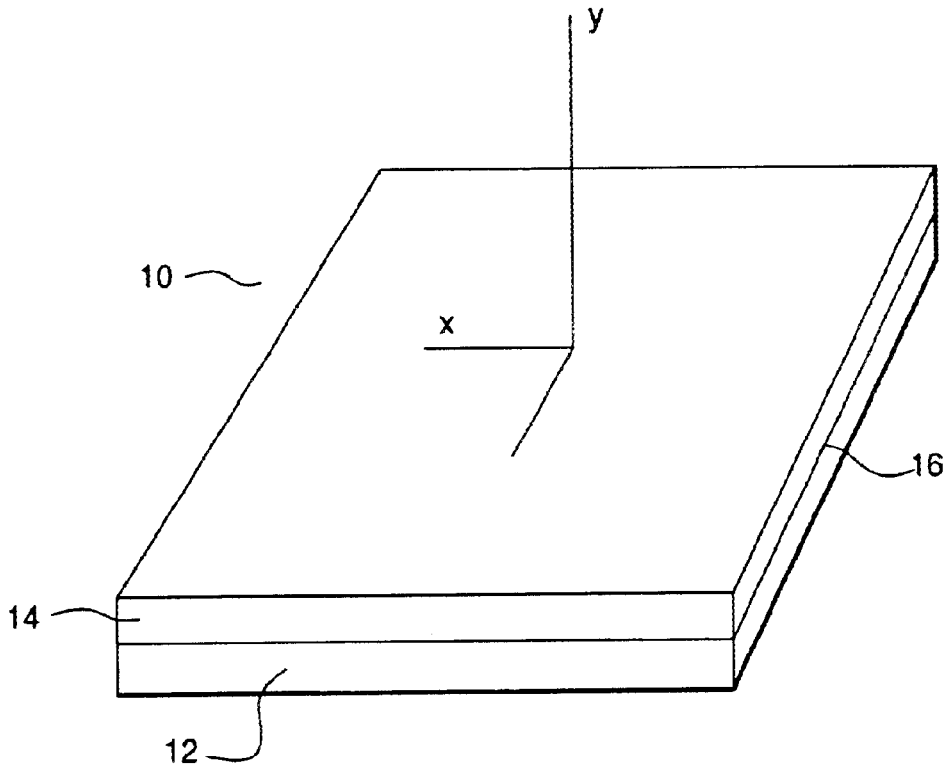
FIGS. 1 and 2 are exposed perspective views of exemplary layered magnets in accordance with the invention.

The present invention is directed to layered magnets, magnetic rolls made therefrom, methods for increasing the magnetic field strength of a ferritic magnet, methods for increasing the magnetic field strength of a magnetic roll, methods for increasing the magnetic field uniformity of a rare earth magnet, and methods for increasing the magnetic field uniformity of a magnetic roll.

Layered magnets in accordance with this invention include a rare earth magnet having a magnetic field, superposed upon the rare earth magnet, a layer of ferritic magnet bonded thereto. Layered magnets in accordance with this invention exhibit a greater magnetic field strength than ferritic magnets alone and a substantially more uniform magnetic field in the direction outward from and normal to the layer of ferritic magnet than the magnetic field in said direction exhibited by the rare earth magnet alone.

Magnetic rolls have a cylindrical core adapted for use with a reprographics apparatus, a rare earth magnet superposed upon the cylindrical core, and superposed upon the rare earth magnet, a layer of ferritic magnet bonded thereto to form a layered magnet. Magnetic rolls having a layered magnet in accordance with this invention exhibit greater magnetic field strength than ferritic magnets alone and a substantially more uniform magnetic field in the direction outward from and normal to the layer of ferritic magnet than the magnetic field exhibited by the rare earth magnet alone.

Methods for increasing the magnetic field strength of a ferritic magnet, such as for example those used for a magnetic roll, include providing a ferritic magnet and superposing upon the ferritic magnet, a layer of rare earth magnet to form at least one layered magnet. Moreover, superposing a layer of a ferritic magnet upon a layer of rare earth magnet such as for example in a magnetic roll, increases the magnetic field uniformity of the rare earth magnet in the direction outward from and normal to the layer of ferritic magnet.

As used herein, a particular magnet's "magnetic field strength" is a measure of the magnetic output in a direction outward from and normal to the magnet. Magnetic field strength is measured by passing a Hall probe down the length of the magnet (usually at a distance of approximately 2–3 millimeters from the surface of the magnet) and taking readings at different points along the length of the magnet.

Variability in "magnetic field uniformity" is determined by calculating the difference between a magnets average magnetic field strength and the magnetic field strength measured at the highest peak and the lowest trough across its magnetic field, respectively. For example, an approximately 10 mm neodymium-iron-boron magnet having an average magnetic field strength of 1500 G, but having a magnetic field strength as low as 1350 G at one point and as high as 1650 G at another point has a +/−10% variability in magnetic field uniformity.

As used herein, "greater magnetic field strength" means layered magnets in accordance with this invention exhibit, as detected by a Hall probe, more magnetic output in the direction outward from and normal to the layer of ferritic magnet, than the magnetic field of a comparable ferritic magnet alone in the same direction.

As used herein, "substantially more uniform" means that a layered magnet in accordance with this invention has a magnetic field having less variation in magnetic field strength across the surface of the magnet in the direction outward from and normal to the layer of ferritic magnet when compared with the variations across the surface of a rare earth magnet alone in the same direction. By way of example, whereas a rare earth, neodymium-iron-boron magnet has approximately +/−10% variability in magnetic field uniformity, a layered magnet will have approximately +/−7% variability, more preferably +/−6% variability, even more preferably +/−5% variability; still more preferably, less than +/−5% variability in the direction outward from and normal to the layer of ferritic magnet.

As used herein "magnetic profile" means a representation, usually conveyed in graphic form, of a magnet's magnetic field strength outward from and normal to its surface at particular points across its surface. In graphic form, the y-axis is a measure of the magnetic field strength of the magnetic field (generally measured in Gauss, "G") at a particular point along the length of the magnet (x-axis).

As used herein, "bonded" means any type of connection, attachment, adhesion, binding, bonding, joining, coupling or any other method known in the art for superposing a magnetic material upon another material. As used herein, "bonded" may also mean combining ferritic magnets and rare earth magnets in a blend provided a method is used such as a magnetic field gradient to substantially segregate the ferrite materials from the rare earth materials, such that the ferritic materials are effectively superposed upon the rare earth materials.

FIG. 1 is an exposed perspective view of an exemplary layered magnet in accordance with this invention. As shown in FIG. 1, an exemplary layered magnet 10 in accordance with this invention includes a rare earth magnet 14, and superposed upon the rare earth magnet 14, a layer of ferritic magnet 12 bonded thereto. Layered magnets 10 in accordance with this invention exhibit greater magnetic field strength relative to ferritic magnets of comparable size and thickness. Further, layered magnets in accordance with this invention exhibit substantially more uniform magnetic field uniformity in the direction outward from and normal to the layer of ferritic magnet relative to the magnetic field in said direction exhibited by a rare earth magnet alone of comparable size and thickness.

Ferritic magnets 12 are composed of any conventional ferritic magnetic materials. In one embodiment, ferritic magnets 12 are composed of ferric oxide and the oxides of one or more metals in such as, for example, manganese, nickel, zinc, barium, or strontium. Ferritic magnets 12, as used herein, may also include other magnetic and/or non-magnetic materials. Preferably, the ferritic magnet 12 is a bonded ferrite magnet. Bonded ferritic magnets are magnets formed from magnetic powders suspended in a binder matrix that can be extruded, calendered, molded, compressed or otherwise formed to create a magnetic article.

Rare earth magnets 14 are composed of any conventional rare earth magnetic materials. In one embodiment, a rare earth magnet 14 comprises any of a series of metallic elements of which the oxides are classed as rare earths and which include the elements of the lanthanide series, such as for example samarium cobalt, neodymium-iron-boron, and/or permanent magnet Alnico, and also yttrium and scandium. Rare earth magnets 14 may also include other magnetic and/or non-magnetic materials.

In another embodiment, a rare earth magnet 14 includes a neodymium magnetic material. In another embodiment, the rare earth magnet 14 may include samarium-cobalt magnetic materials, or a combination of neodymium magnetic materials and samarium-cobalt magnetic materials. Preferably, the rare earth magnet 14 is a neodymium-iron-boron magnet.

In another embodiment, layered magnets 10 in accordance with this invention include a binder. The binder is blended with a magnetic powder that is compressed to form a layer of bonded ferritic magnetic material. Binders include those conventionally used by those skilled in the powder metallurgical arts. Binders include polymers, such as for example Nylon 12, PPS, Polyamide, Nylon 6, Hypalon, Nitrile. Binders are also available under the trade names Nordel® (E. I. Du Pont de Nemours and Company) and Natsyn® (Goodyear Tire & Rubber Co.).

In another embodiment, layered magnets 10 in accordance with this invention include a bonding layer 16. The bonding layer 16 is an adhesive for joining a layer of ferritic magnet 12 to a rare earth magnet 14. Adhesives include any conventional adhesive known to those skilled in the art for joining layers of magnets. Adhesives include, for example, epoxy based adhesives, resin based adhesives and phenol based adhesives. In addition to binders and/or adhesives, the magnetic material may be joined by any means known in the art to permanently or releasably join magnetic material such as for example by magnetic bonding, melt bonding techniques, injection molding techniques, compression molding techniques, extrusion molding techniques, calendaring techniques, and calendaring methods.

A description of exemplary extrusion processes and co-extrusion processes can be found in Perry's Chemical Engineering Handbook, Ch. 18, pp. 29–32 (1997) which is herein incorporated by reference.

Figure 2:
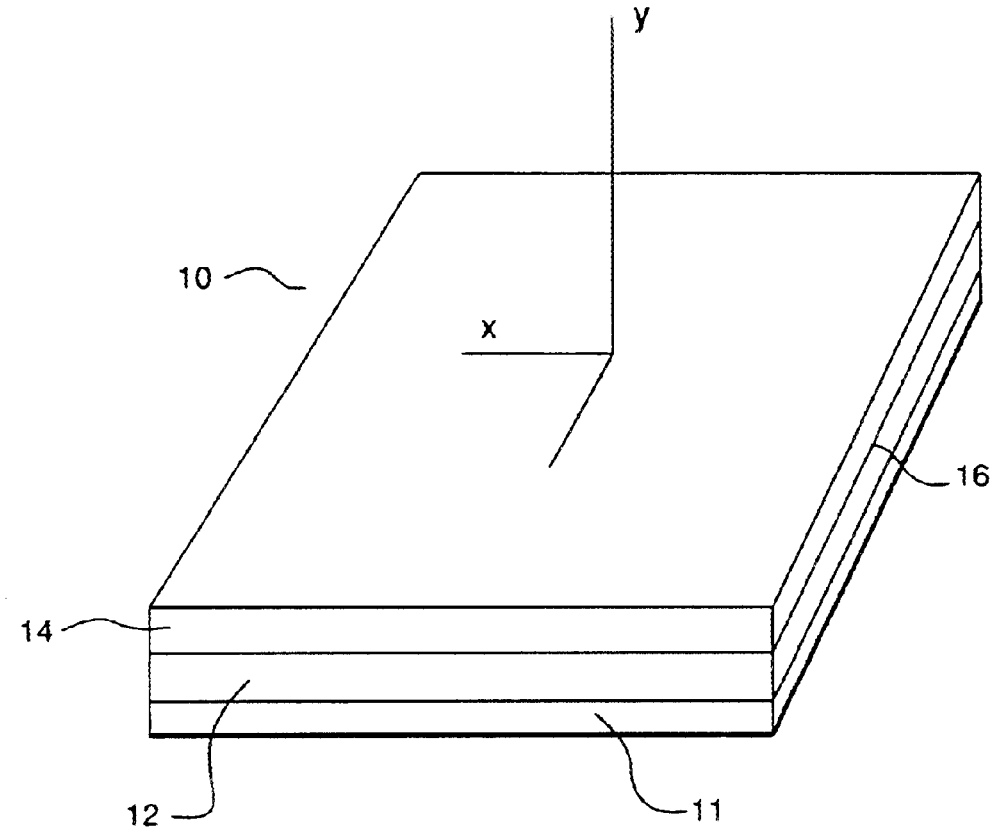

As shown in FIG. 2, in alternative embodiments of the present invention, layered magnets 10 in accordance with this invention may include at least one additional layer 11 of magnetic or non-magnetic material. The additional layer 11 may be superposed upon the rare earth magnet 14 or disposed between the rare earth magnet 14 and the ferritic magnet 12. Additional layers 11 of magnetic material may include ferritic magnetic materials, rare earth magnetic materials, and combinations of both.

Figure 3:
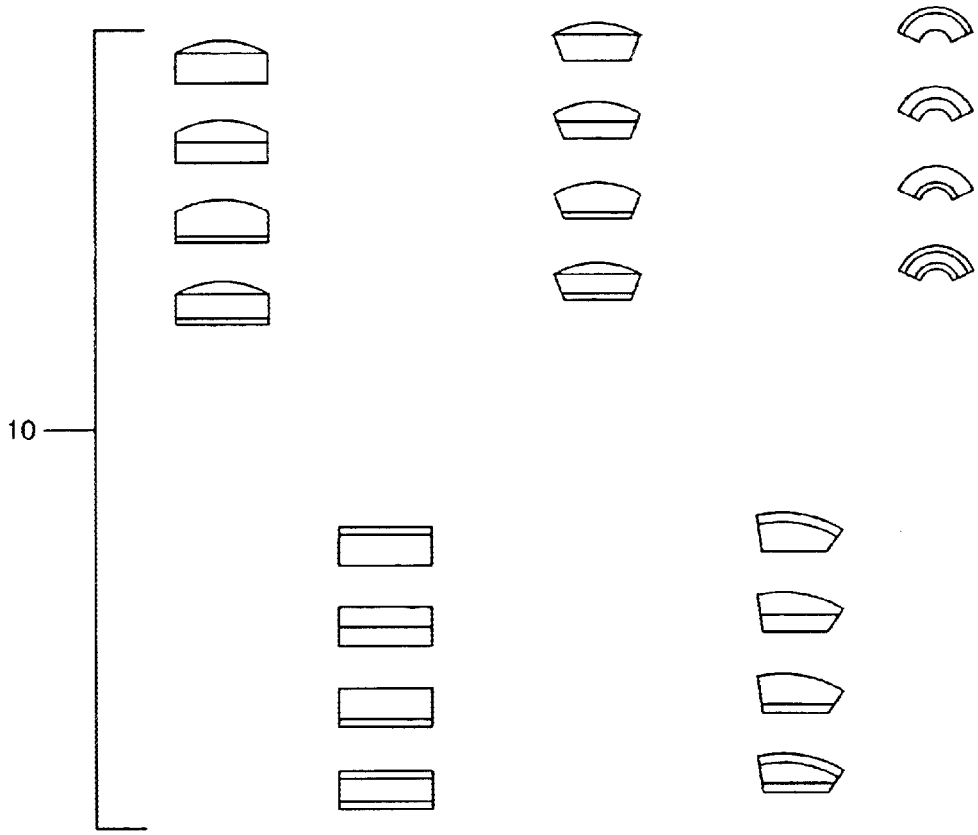
FIG. 3 shows cross sectional views of exemplary layered magnets.

Still in other alternative embodiments of the present invention, layered magnets 10 in accordance with this invention may be formed in any shape known to those skilled in the art. For example, layered magnets in accordance with this invention can be formed into strips, sheets, blocks, segments and rings. As shown in FIG. 3, exemplary layered magnets 10 in accordance with this invention are rectangular, crown-shaped, symmetric keystone shaped, asymmetric keystone shaped, or in the shape of an arc segment. Preferably, layered magnets 10 in accordance with this invention are planar in shape. In an exemplary layered magnet 10 in accordance with this invention, the layer of ferritic magnet 12 may be thinner than the rare earth magnet 14, the same thickness as the rare earth magnet 14, or thicker than the rare earth magnet 14. The thickness of the 12 ferritic and 14 rare earth magnets may vary depending on the desired final magnetic field strength and magnetic field uniformity.

The thickness of the layer of ferritic magnet 12 may be from about 0.1 mm to about 25 mm. The thickness of the rare earth magnet 14 may be from about 0.1 mm to about 50 mm. More preferably, the thickness of the layer of ferritic magnet 12 is from 1 mm to 2 mm, and the thickness of the rare earth magnet 14 is about 3 mm to 6 mm. Even more preferably, the thickness of the layer of ferritic magnet 12 is about 1 mm, and the thickness of the rare earth magnet 14 is about 3 mm. The ratio of the thickness of the layer of ferritic magnet to the rare earth magnet is preferably between 1:3 and 1:5, and even more preferably 1:3.

The magnetic field strength of an exemplary layered magnet 10 in accordance with this invention may be from about 800 G to 2500 G when measured with a Hall probe at a distance of 2–3 mm from the ferritic surface of the magnet. More preferably, the magnetic field strength of a layered magnet 10 in accordance with this invention may be from about 1000 G to. 1500 G. Even more preferably, the magnetic field strength of a layered magnet 10 in accordance with this invention may be from about 1000 to 1200 G.

Layered magnets 10 in accordance with this invention, having greater magnetic field strength, provide an alternative to ferritic magnets of comparable size and thickness. For example, there may be applications where limited space requires a 10 layered magnet to achieve the necessary magnetic field strength whereas if more space were provided, a ferritic magnet alone might be sufficient. Similarly, layered magnets 10 in accordance with this invention, having a substantially more uniform magnetic field, provide an alternative to rare earth magnets of comparable size and thickness. Layered magnets 10 in accordance with this invention may be used to make magnetic rolls 20, advertising specialties (signs and labels), micromotor magnets, linear motors, actuators, medical MRI machines, biomedical, surgical drapes, car ski-rack restraint systems, and automotive sound deadening systems.

Figure 4:
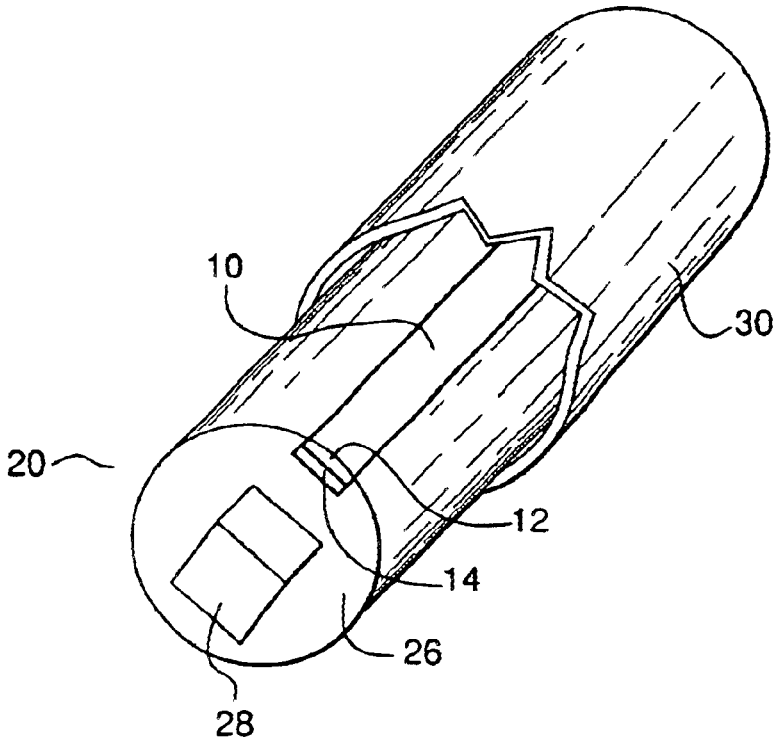
FIG. 4 is an exposed perspective view of an exemplary magnetic roll.
Figure 5A:
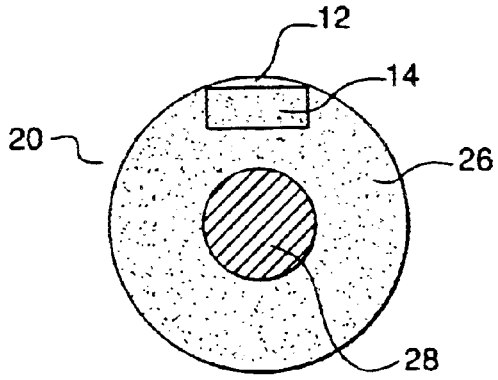
FIG. 5 are cross sectional views of exemplary magnetic rolls.
Figure 5B:
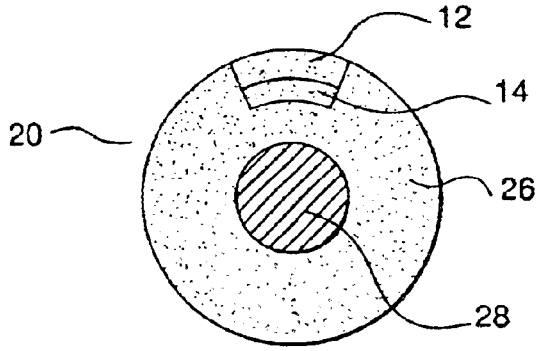
Figure 5C:
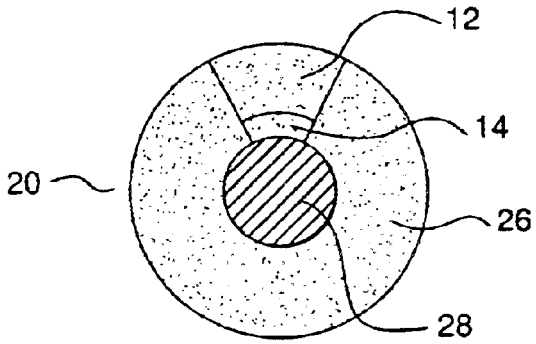

FIG. 4 is an exposed perspective view of an exemplary magnetic roll 20. FIGS. 5 (a), (b) and (c) are cross sectional views of exemplary magnetic rolls 20. As shown in FIGS. 4 and 5, a magnetic roll 20 includes a cylindrical core 26, a rare earth magnet 14 and superposed upon the rare earth magnet 14, a layer of ferritic magnet 12 bonded thereto to form a layered magnet 10. Magnetic rolls 20 having at least one layered magnet 10 in accordance with this invention exhibit greater magnetic field strength, a substantially more uniform magnetic field, temperature stability, corrosion resistance and molding properties and accordingly are ideal for use in high image quality applications. Conventional magnetic rolls are described in, for example, U.S. Pat. Nos. 6,421,519 and 4,638,281 which are herein incorporated by reference in their entireties.

A cylindrical core 26 may be made of non-magnetic material or magnetic material as is known to those of skill in the art. The cylindrical core may have a plurality of magnetic poles extending on its surface along a longitudinal direction and a shaft 28 fixed concentrically to a center portion of the cylindrical core 26.

As shown in FIG. 4, the magnetic roll 20 may include a cylindrical sleeve 30. The sleeve 30 fixed to both ends thereof may be made of non-magnetic materials such as aluminum alloys or austenitic stainless steel.

The cylindrical core is usually an elongated one having an outer diameter D of 10–60 mm and a length L of 200–300 mm, and is formed of an isotropic sintered ferrite magnet, or an anisotropic bonded magnet mainly composed of ferromagnetic particles (Sr ferrite or Ba ferrite) and a resin (polyamides, chlorinated polyethylene, etc.). The anisotropic bonded magnet is produced, for instance, by heat-blending a mixture of starting materials, extrusion-molding or injection-molding the molten blend in a magnetic field and then magnetizing the molded product according to a magnetization pattern.

With the above structure, a magnetic developer is attracted onto a surface of the sleeve 30 and conveyed to a developing region (region in which the image-bearing member is positioned in opposite to the sleeve) by a relative rotation of the magnetic roll 20 and the sleeve 30 to develop the electrostatic image.

The magnetic force required for a conventional magnetic roll 20 is about 500–800 G on a sleeve 30 surface, suitable for almost all developing processes. However, recent demand for higher image quality has called for a magnetic field strength as a high as about 1000–1300 G. A magnetic roll having a layered magnet is capable of meeting the demand for higher image quality as it exhibits greater magnetic field strength.

At the same time, magnetic field uniformity remains of paramount concern. Whereas a conventional rare earth neodymium-iron-boron magnet, having sufficient magnetic field strength, lacks in magnetic field uniformity, presently-preferred 10 layered magnets meet the demand for greater magnetic field strength while at the same time having a substantially more uniform magnetic field in the direction outward from and normal to the layer of 12 ferritic magnet than the magnetic field in said direction exhibited by the rare earth magnet alone.

An exemplary embodiment of a ferritic magnet 12 comprises ferric oxide combined with the oxides of one or more metals (such as manganese, nickel, zinc, barium, or strontium. Such materials may also be hybrid magnetic materials including other magnetic and/or non-magnetic materials.

An exemplary embodiment of a rare earth magnet 14 comprises any of a series of metallic elements of which the oxides are classed as rare earths and which include the elements of the lanthanide series, such as for example samarium cobalt, neodymium iron boron, and/or permanent magnet Alnico, and also yttrium and scandium. Rare earth magnets 14 may also include other magnetic and/or non-magnetic materials.

Magnetic rolls 20 are fabricated using any method known to those skilled in the art. For example, methods of making magnetic rolls include injection molding, compression molding, and extrusion molding as described above.

It is to be understood that even though numerous characteristics and advantages of the present invention have been set forth in the foregoing description, together with details of the structure and function of the invention, the disclosure is illustrative only, and that changes may be made in detail, especially in matters of shape, size and materials, within the principles of the invention.

EXAMPLES

Example 1

One passing a Hall probe down the length of an approximately 10 mm neodymium-iron-boron, rare earth magnet at a distance of 2 to 3 mm from the surface of the magnet will find a magnetic field strength of approximately 1500 G. By taking readings at various points down the length of the magnet, one will find the magnetic field strength at one point as high as approximately 1650 G and at another point as low as approximately 1350 G, for a variability of +/−10%. If one passes a Hall probe down the length of an approximately 12 mm layered magnet, having approximately a 2 mm layer of ferritic magnet superposed on an approximately 10 mm neodymium-iron-boron magnet, having a magnetic field strength of approximately 1000 G, one will find the magnetic field strength at one point as high as approximately 1050 G and at another point as low as approximately 950 G, for a variability of +/−5%. Results will vary depending upon, but not limited to, the thickness and quality of the magnets.

Example 2

One passing a Hall probe down the length of an approximately 10 mm ferritic magnet at a distance of 2 to 3 mm from the surface of the ferritic magnet will fund a magnetic field strength of approximately 800 G. If one passes a Hall probe down the length of a layered magnet, having approximately a 2 mm layer of ferritic magnet superposed on an approximately 10 mm neodymium-iron-boron, rare earth magnet, one will find a magnetic field strength of approximately 1000 G. Results will vary depending upon, but not limited to, the thickness and quality of the magnets.

What is claimed:

1. A magnetic roll comprising a cylindrical core adapted for use with a reprographics apparatus, superposed upon the cylindrical core, at least one layered magnet;

the layered magnet comprising a rare earth magnet having a magnetic field, and superposed upon the rare earth magnet, a layer of ferritic magnetic material bonded thereto;

the magnetic field of the layered magnet in the direction outward from and normal to the layer of ferritic magnet being substantially more uniform than the magnetic field in said direction exhibited by the rare earth magnet alone.

2. The magnetic roll of claim 1 further comprising a bonding layer.

3. The magnetic roll of claim 1 further comprising an additional layer of magnetic material.

4. The magnetic roll of claim 3 wherein said additional layer of magnetic material comprises a ferritic magnet, a rare earth magnet, or combinations thereof.

5. The magnetic roll of claim 1 wherein said rare earth magnet comprises a neodymium-iron-boron magnet.

6. The magnetic roll of claim 1 wherein said ferritic magnet, said rare earth magnet, or both said ferritic magnet and said rare earth magnet comprise a binder.

7. A method for increasing the magnetic field strength of a magnetic roll comprising:

providing a ferritic magnet having a magnetic field, superposing upon the ferritic magnet, a layer of rare earth magnet and bonding said layer thereto to form a layered magnet, providing a cylindrical core adapted for use with a reprographics apparatus, superposing upon said cylindrical core, said layered magnet, the magnetic field strength of the magnetic roll in the direction outward from and normal to the layer of ferritic magnet being substantially greater than the magnetic field strength in said direction exhibited by the ferritic magnet alone.

8. The method of claim 7 further comprising providing a bonding layer between said ferritic magnet and said rare earth magnet.

9. The method of claim 7 further comprising the step of superposing upon said layered magnet an additional layer of magnetic material.

10. The method of claim 9 wherein said additional layer comprises a ferritic magnet material, a rare earth magnet material, or combinations thereof.

11. The method of claim 7 further comprising the step of superposing upon said layered magnet an additional layer of non-magnetic material.

12. The method of claim 7 wherein said rare earth magnet comprises a neodymium-iron-boron magnet.

13. The method of claim 7 wherein said ferritic magnet, said rare earth magnet, or both said ferritic magnet and said rare earth magnet comprise a binder.

14. The method of claim 7 further comprising the step of superposing upon said cylindrical core said rare earth magnet.

15. A method for increasing the magnetic field uniformity of a magnetic roll comprising:

providing a rare earth magnet having a magnetic field, superposing upon the rare earth magnet, a layer of ferritic magnet and bonding said layer thereto to form a layered magnet, providing a cylindrical core adapted for use with a reprographics apparatus, superposing upon said cylindrical core, said layered magnet, the magnetic field of the magnetic roll in the direction outward from and normal to the layer of ferritic magnet being substantially more uniform than the magnetic field in said direction exhibited by the rare earth magnet alone.

16. The method of claim 15 further comprising the step of providing a bonding layer between said ferritic magnet and said rare earth magnet.

17. The method of claim 15 further comprising the step of superposing upon said layered magnet an additional layer of magnetic material.

18. The method of claim 17 wherein said additional layer comprises a ferritic magnet material, a rare earth magnet material, or combinations thereof.

19. The method of claim 17 further comprising the step of superposing upon said layered magnet an additional layer of non-magnetic material.

20. The method of claim 15 wherein said rare earth magnet comprises a neodymium-iron-boron magnet.

21. The method of claim 15 wherein said ferritic magnet, said rare earth magnet, or both said ferritic magnet and said rare earth magnet comprise a binder.

* * * * *